US008297267B2

(12) United States Patent
Popov et al.

(10) Patent No.: US 8,297,267 B2
(45) Date of Patent: Oct. 30, 2012

(54) UNIT FOR FASTENING OF THE BOWSTRING THROWING DEVICES (VARIANTS)

(76) Inventors: Sergey Olegovich Popov, Moscow (RU); Pavel Vitalievich Ivanov, Moscow (RU); Sergey Anatolievich Golovatyy, Moscow (RU)

( * ) Notice: Subject to any disclaimer, the term of this patent is extended or adjusted under 35 U.S.C. 154(b) by 997 days.

(21) Appl. No.: 11/916,529

(22) PCT Filed: Aug. 30, 2007

(86) PCT No.: PCT/RU2007/000460
§ 371 (c)(1),
(2), (4) Date: Dec. 4, 2007

(87) PCT Pub. No.: WO2008/030139
PCT Pub. Date: Mar. 13, 2008

(65) Prior Publication Data

US 2010/0132684 A1 Jun. 3, 2010

(30) Foreign Application Priority Data

Sep. 7, 2006 (RU) ..... 2006132230

(51) Int. Cl.
*F41B 5/12* (2006.01)

(52) U.S. Cl. ..... 124/25.6; 124/23.1; 124/25; 124/86; 124/87

(58) Field of Classification Search ..... 124/23.1, 124/25, 25.6, 86, 87
See application file for complete search history.

(56) References Cited

U.S. PATENT DOCUMENTS 4,337,749 A * 7/1982 Barna ..... 124/25.6
4,440,142 A * 4/1984 Simonds ..... 124/25.6
4,774,927 A * 10/1988 Larson ..... 124/25.6
4,976,250 A * 12/1990 Jeffrey ..... 124/25
5,119,797 A * 6/1992 Anderson ..... 124/25
5,381,777 A * 1/1995 Mitchell et al. ..... 124/25.6
5,630,405 A * 5/1997 Nizov ..... 124/25
5,823,172 A * 10/1998 Suggitt ..... 124/25
5,881,705 A * 3/1999 Howell et al. ..... 124/25.6
5,934,265 A * 8/1999 Darlington ..... 124/25.6
6,082,347 A * 7/2000 Darlington ..... 124/25.6
6,155,243 A * 12/2000 Gallops, Jr. ..... 124/25
6,237,582 B1 * 5/2001 McPherson ..... 124/25.6
6,247,466 B1 * 6/2001 McPherson ..... 124/25.6
(Continued)

*Primary Examiner* — Gene Kim
*Assistant Examiner* — Alexander Niconovich

(57) ABSTRACT

A unit for fastening a bowstring of a throwing device the containing a first pulley mounted with a possibility of rotation about the axis of rotation of the first pulley and having the first and the second peripheral surfaces, the second pulley mounted with a possibility of rotation about the axis of rotation of the second pulley, spaced apart from the axis of rotation of the first pulley and having the first and the second peripheral surfaces, a bowstring for throwing a projectile having one end fixed to the first pulley, and other end fixed to the second pulley so the bowstring for throwing a projectile is, at least, partly wrapping the first peripheral surfaces of the first and the second pulleys, the first tension bowstring having one end fixed to the axis of rotation of the first pulley, and other end fixed to the second pulley so the first tension bowstring is, at least, partly wrapping the second peripheral surface of the second pulley, the second tension bowstring having one end fixed to the axis of rotation of the second pulley, and the other end fixed to the first pulley, so the second tension bowstring is, at least, partly wrapping the second peripheral surface of the first pulley and intersects the first tension bowstring, thus when rendering the throwing device in the cocked position the bowstring for throwing a projectile intersects the first and the second tension bowstrings.

18 Claims, 5 Drawing Sheets

U.S. PATENT DOCUMENTS 6,267,108 B1 * 7/2001 McPherson et al. ..... 124/25
6,321,736 B1 * 11/2001 McPherson ..... 124/25.6
6,460,528 B1 * 10/2002 Gallops, Jr. ..... 124/25
6,516,790 B1 * 2/2003 Darlington ..... 124/25.6
6,575,153 B2 * 6/2003 Lommasson et al. ..... 124/25.6
6,871,643 B2 * 3/2005 Cooper et al. ..... 124/25.6
6,901,921 B1 * 6/2005 Barnett ..... 124/25
6,990,970 B1 * 1/2006 Darlington ..... 124/25.6
7,100,590 B2 * 9/2006 Chang ..... 124/25
7,178,514 B2 * 2/2007 Chang ..... 124/25
7,188,615 B2 * 3/2007 Chang ..... 124/25.6
7,281,534 B2 * 10/2007 Bednar ..... 124/25
7,328,693 B2 * 2/2008 Kempf ..... 124/25
7,363,921 B2 * 4/2008 Kempf ..... 124/25
7,441,555 B1 * 10/2008 Larson ..... 124/25.6
7,506,643 B2 * 3/2009 Holmberg ..... 124/86
7,578,289 B2 * 8/2009 Norkus ..... 124/25.6
7,584,750 B2 * 9/2009 Chang ..... 124/25
7,624,724 B2 * 12/2009 Bednar et al. ..... 124/25
7,624,725 B1 * 12/2009 Choma ..... 124/25
7,708,001 B2 * 5/2010 Kempf ..... 124/25.6
7,721,721 B1 * 5/2010 Kronengold et al. ..... 124/25.6
7,784,453 B1 * 8/2010 Yehle ..... 124/25
7,938,109 B1 * 5/2011 Larson ..... 124/25.6
8,020,544 B2 * 9/2011 McPherson et al. ..... 124/25.6
2002/0059924 A1 * 5/2002 Bednar ..... 124/25
2003/0089359 A1 * 5/2003 Bednar ..... 124/25
2005/0193998 A1 * 9/2005 Cooper et al. ..... 124/25.6
2006/0144381 A1 * 7/2006 Kempf et al. ..... 124/25
2006/0169258 A1 * 8/2006 Chang ..... 124/25
2006/0169259 A1 * 8/2006 Chang ..... 124/25
2006/0169260 A1 * 8/2006 Chang ..... 124/25.6
2007/0068501 A1 * 3/2007 Bednar ..... 124/25
2007/0101979 A1 * 5/2007 Bednar et al. ..... 124/25
2007/0221184 A1 * 9/2007 Kempf ..... 124/25.6
2008/0072888 A1 * 3/2008 Chang ..... 124/25
2008/0127956 A1 * 6/2008 Bednar et al. ..... 124/25
2008/0168969 A1 * 7/2008 Kempf ..... 124/25
2008/0251058 A1 * 10/2008 Colley ..... 124/25
2009/0000607 A1 * 1/2009 Miller ..... 124/25.6
2009/0101126 A1 * 4/2009 Anderson ..... 124/25
2009/0145411 A1 * 6/2009 Sims et al. ..... 124/25.6
2010/0089375 A1 * 4/2010 McPherson et al. ..... 124/25.6
2010/0116259 A1 * 5/2010 Popov et al. ..... 124/25
2010/0186728 A1 * 7/2010 Bednar et al. ..... 124/25

* cited by examiner

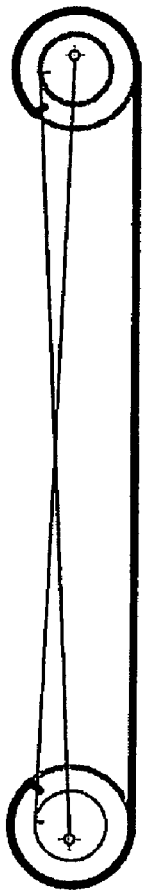
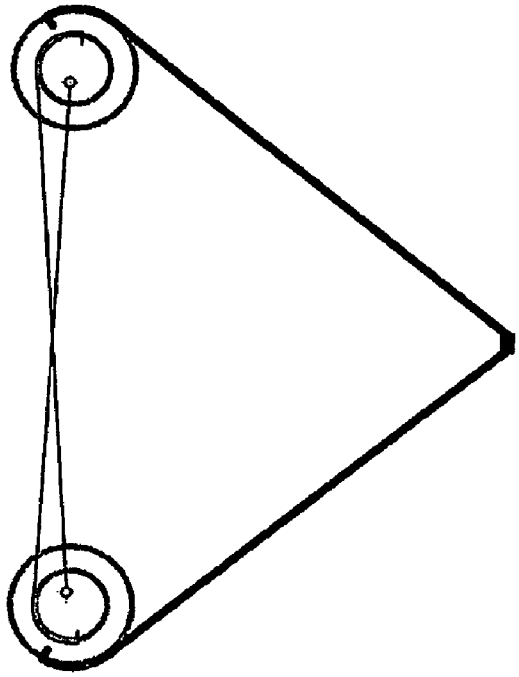
Fig. 2
Fig. 1

UNIT FOR FASTENING OF THE BOWSTRING THROWING DEVICES (VARIANTS)

PERTINENT ART

The invention relates to throwing devices and, in particular, to unit for fastening a bowstring of throwing devices, such as, for example, a bow or a crossbow. More particularly, the invention relates to units for fastening a bowstring of throwing devices of pulley type.

STATE OF THE ART

The pulley fastening of a bowstring for throwing devices have appeared rather recently, at the end of fifties. The attribute and advantage of such a pulley fastening is provision for tension release in the final point of tension and acceleration of a throwing projectile at the moment of release. Thus, throwing devices with pulley fastening of a bowstring are the fastest and have the most space saving design. Thus, all the technical decisions aimed at improving the design of throwing devices according to prior knowledge, are basically aimed at perfection of used materials, and at various designs optimizing the process of assembly and disassembly of the throwing weapon. Here the term "throwing weapon" means any throwing weapon providing the throwing of various projectiles (e.g. a bow, a crossbow, etc.).

In the known designs of the throwing weapon disclosed, e.g., in U.S. Pat. Nos. 4,722,318, 6,460,528 or 5,465,705, there is used a unit for fastening a bowstring of the throwing device (see FIGS. 1 and 2), containing a pair of pulleys mounted with a possibility of rotation about corresponding axes of rotation of pulleys, spaced apart, and having the first and the second peripheral surfaces, accordingly. Thus the bowstring for throwing a projectile has one end fixed to the first pulley and the other end fixed to the second pulley, partly wrapping the first peripheral surfaces of the first and the second pulleys; the first tension bowstring has one end fixed to the axis of rotation of the first pulley, and the other end fixed to the second pulley, partly wrapping the second peripheral surface of the second pulley, while the second tension bowstring has one end fixed to the axis of rotation of the second pulley, and other end fixed to the first pulley, partly wrapping the second peripheral surface of the first pulley and intersecting the first tension bowstring, thus when rendering the throwing device to the cocked position the bowstring for throwing a projectile passes in such a manner that it is not intersecting the first and the second tension bowstrings.

SUMMARY OF THE INVENTION

The object of this invention is to improve the known unit for fastening a bowstring of the throwing device for providing an increase in initial speed of a projectile.

According to the first object of this invention the unit for fastening a bowstring of the throwing device is created, containing: a first pulley mounted with a possibility of rotation about the axis of rotation of the first pulley and having the first and the second peripheral surfaces, the second pulley mounted with a possibility of rotation about the axis of rotation of the second pulley, spaced apart from the axis of rotation of the first pulley, and having the first and the second peripheral surfaces, a bowstring for throwing the projectile, having one end fixed to the first pulley, and the other end fixed to the second pulley so the bowstring for throwing a projectile is, at least, partly wrapping the first peripheral surfaces of the first and the second pulleys, a first tension bowstring having one end fixed to the axis of rotation of the first pulley, and other end fixed to the second pulley so the first tension bowstring is, at least, partly wrapping the second peripheral surface of the second pulley, a second tension bowstring having one end fixed to the axis of rotation of the second pulley, and the other end fixed to the first pulley, so the second tension bowstring is, at least, partly wrapping the second peripheral surface of the first pulley and intersecting the first tension bowstring, thus when rendering the throwing device to the cocked position the bowstring for throwing a projectile intersects the first and the second tension bowstrings.

According to the second object of this invention the unit for fastening a bowstring of the throwing device is created, containing: a first pulley mounted with a possibility of rotation about the axis of rotation of the first pulley and having the first and the second peripheral surfaces, a second pulley mounted with a possibility of rotation about axis of rotation of the second pulley, spaced apart from the axis of rotation of the first pulley, having the first and the second peripheral surfaces, a bowstring for throwing the projectile, having one end fixed to the first pulley, and the other end fixed to the second pulley so the bowstring for throwing a projectile is, at least, partly wrapping the first peripheral surfaces of the first and the second pulleys; a first tension bowstring; a second tension bowstring, a first element for fastening the bowstring, mounted on the axis of rotation of the first pulley, and the second element for fastening the bowstring, mounted on the axis of rotation of the second pulley, thus the first tension bowstring has one end fixed to the first element for fastening the bowstring, and the other end fixed to the second pulley, so the first tension bowstring is, at least, partly wrapping the second peripheral surface of the second pulley, the second tension bowstring has one end fixed by to the second element for fastening the bowstring, and other end fixed to the first pulley so the second tension bowstring is, at least, partly wrapping the second peripheral surface of the first pulley and intersects the first tension bowstring, and when rendering the throwing device to the cocked position the bowstring for throwing a projectile intersects the first and the second tension bowstrings.

According to the third object of this invention the unit for fastening a bowstring of the throwing device is created, containing: a first pulley mounted with a possibility of rotation about the axis of rotation of the first pulley and having the first, the second and the third peripheral surfaces, a second pulley mounted with a possibility of rotation about axis of rotation of the second pulley, spaced apart from the axis of rotation of the first pulley, and having the first, the second and the third peripheral surfaces, a bowstring for throwing the projectile, having one end fixed to the first pulley, and the other end fixed to the second pulley so the bowstring for throwing a projectile is, at least, partly wrapping the first peripheral surfaces of the first and the second pulleys, the first tension bowstring having one end fixed to the first pulley, and the other end fixed to the second pulley so the first tension bowstring is, at least, partly wrapping the second peripheral surfaces of the first and the second pulleys, the second tension bowstring having one end fixed to the second pulley, and the other end fixed to the first pulley, so the second tension bowstring is, at least, partly wrapping the third peripheral surfaces of the first and the second pulleys intersecting the first tension bowstring, thus when rendering the throwing device to the cocked position the bowstring for throwing a projectile intersects the first and the second tension bowstrings.

According to the fourth object of this invention the unit for fastening a bowstring of the throwing device is created, containing: a first pulley mounted with a possibility of rotation about the axis of rotation of the first pulley and having the first, the second and the third peripheral surfaces, a second pulley mounted with a possibility of rotation about axis of rotation of the second pulley, spaced apart from the axis of rotation of the first pulley, and having the first, the second and the third peripheral surfaces, a bowstring for throwing the projectile, having one end fixed to the first pulley, and the other end fixed to the second pulley so the bowstring for throwing a projectile is, at least, partly wrapping the first peripheral surfaces of the first and the second pulleys, the first tension bowstring having one end fixed to the first pulley, and other end fixed to the second pulley so the first tension bowstring is, at least, partly wrapping the second peripheral surface of the first pulley and the third peripheral surface of the second pulley, the second tension bowstring having one end fixed to the second pulley, and other end fixed to the first pulley, so the second tension bowstring is, at least, partly wrapping the third peripheral surface of the first pulley and the second peripheral surface of the second pulley and intersects the first tension bowstring, thus when rendering the throwing device to the cocked position the bowstring for throwing a projectile intersects the first and the second tension bowstrings.

Preferably, the pulleys have a round or elliptic shape or any other shape known in the art.

The axis of rotation of each pulley can pass through the center of this pulley, or can be displaced about the center of this pulley.

The above disclosed unit can be mounted on a crossbow or a bow or on any other suitable throwing weapon.

The offered design provides an increase of power stroke length of a bowstring for throwing a projectile at a value equal to the diameter of the pulley, without changing the overall dimensions of throwing devices. In turn, the increase of the power stroke leads to increase of energy applied to a projectile, due to increase of time of application of force. Moreover, at equal overall dimensions of throwing devices, the angle formed by the bowstring for throwing a projectile in the cocked position is smaller than that of a conventional fastening of a bowstring. Such a reduction of the angle of application of force to a throwing projectile results in increase in the force effecting the throwing projectile.

BRIEF DESCRIPTION OF THE FIGURES

Further this invention will be described in more detail with the use of applied graphic materials, where:

FIG. 1—unit for fastening a bowstring according to previous art in a not cocked position;

FIG. 2—unit for fastening a bowstring according to previous art of in a cocked position;

DETAILED DESCRIPTION OF VARIANTS OF EMBODIMENT OF THE INVENTION

Further the invention will be described in more detail with example of variants of its embodiment. The proposed unit for fastening a bowstring can be used with any type of throwing device, such as a crossbow, a bow, etc.

Figure 3:
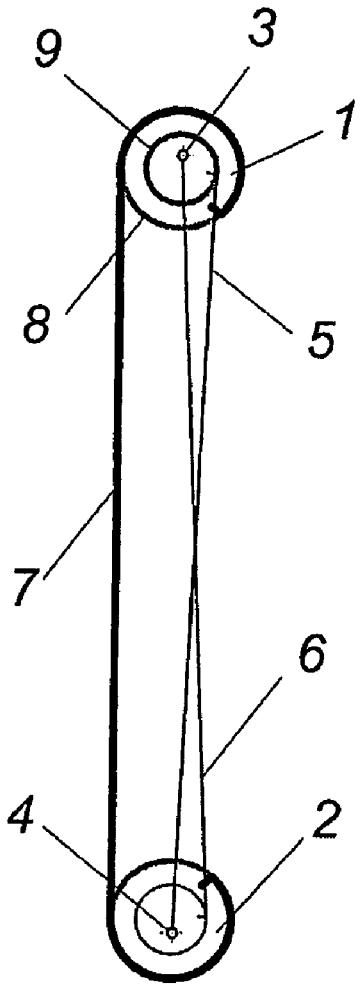
FIG. 3—unit for fastening a bowstring according to this invention in a not cocked position.
Figure 4:
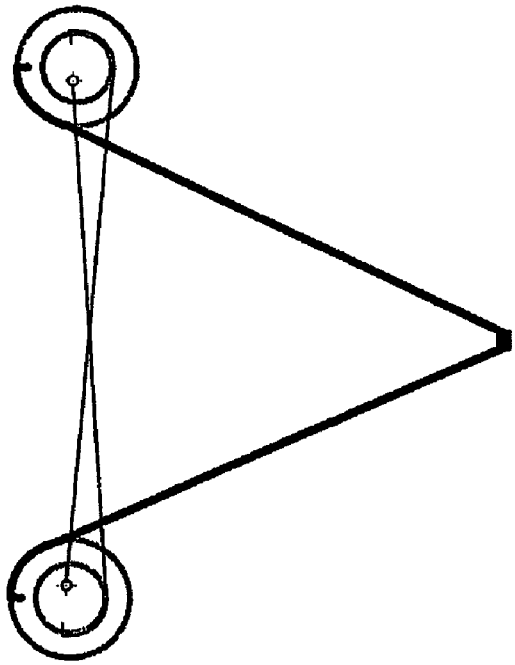
FIG. 4—unit for fastening a bowstring according to this invention in a cocked position.

In FIG. 3 the claimed unit for fastening a bowstring of a throwing device which includes two pulleys is shown: the first pulley and the second pulley 2. The pulleys 1 and 2 are mounted accordingly on axes 3 and 4 and are made so as to provide for rotation about those axes. The axes 3 and 4 may be positioned both in the center of the pulley, and with displacement from such a center of pulley. Between the pulleys 1 and 2 three bowstrings are drawn: two tension bowstrings 5 and 6 and one bowstring 7 for throwing a projectile.

Figure 5:
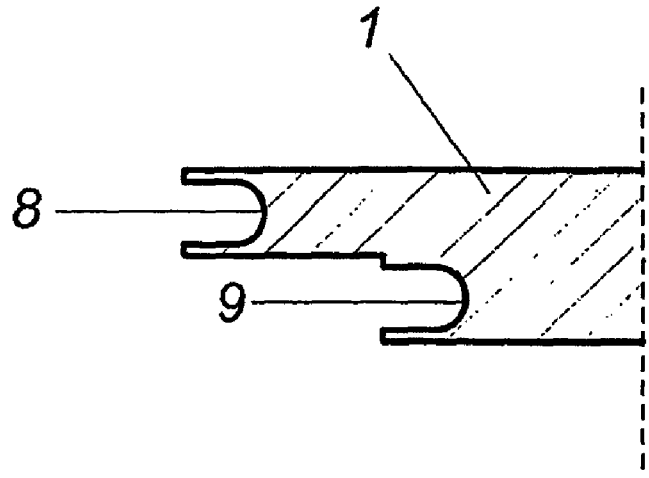
FIG. 5—sectional view of the pulley used in the unit for fastening a bowstring according to this invention.

Thus the pulleys have such a configuration that they are forming various surfaces on which the bowstrings are reeled up. In FIG. 5 the section of the pulley 1 (the pulley 2 has the same configuration as the pulley 1) of variant of unit for fastening a bowstring where two essentially cylindrical peripheral surfaces 8 and 9 having different diameters is shown. In other variants of embodiment of the invention there may be two or three such surfaces, and they may have various shape, e.g., round or elliptic, their cross section sizes may be also different.

In a variant when pulleys have two peripheral surfaces: the first 8 and the second 9, the bowstring 7 for throwing a projectile is reeled up on the first peripheral surfaces 8, while the tension bowstrings 5 and 6 are reeled up on the second peripheral surfaces 9. Thus, in the variant of embodiment shown in FIG. 3, the tension bowstring 5 is fixed to the axis 4 of the pulley 2 and is, at least, partly wrapping the peripheral surface 9 of pulleys, while the second tension bowstring is fixed to the axis 3 of pulley 2 and is partly wrapping the peripheral surface of the pulley 2. The bowstring 7 for throwing of a projectile have its ends fixed to the pulleys 1 and 2 and passes in such a manner that it is, at least, partly wrapping the peripheral surfaces of 8 pulleys 1 and 2.

Figure 6:
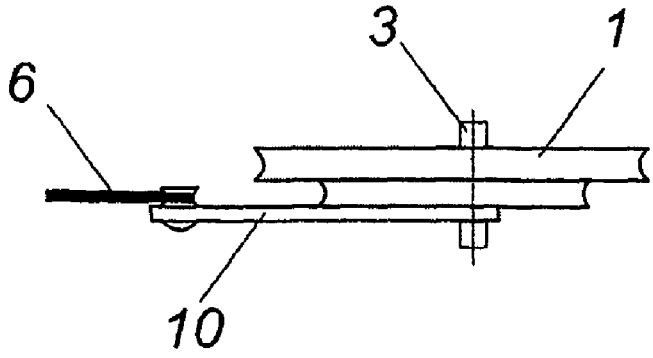
FIG. 6—side view of the pulley with an element for fastening the bowstring mounted on its axis of rotation used in the unit for fastening a bowstring according to this invention.
Figure 8:
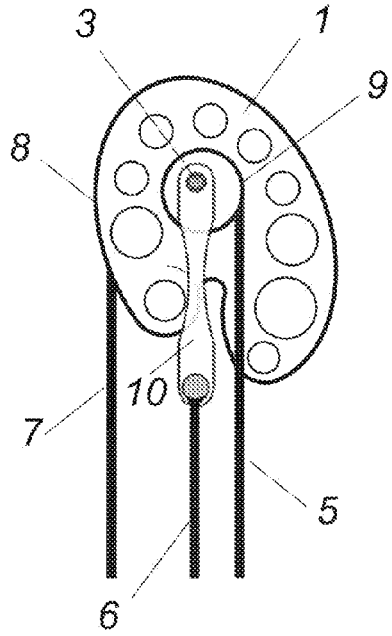
FIG. 8—top view of the pulley having an elliptic shape with an element for fastening a tension bowstring.
Figure 9:
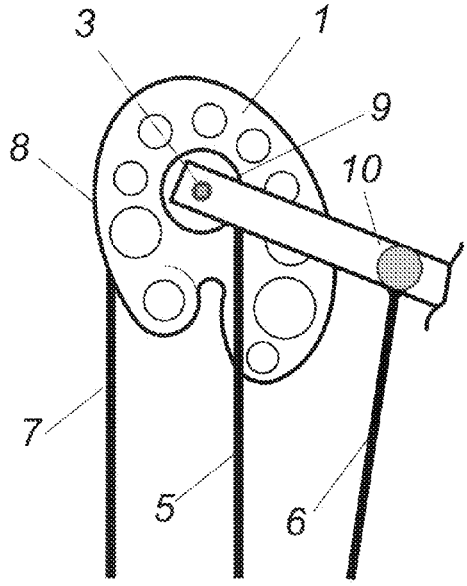
FIG. 9—pulley having an elliptic shape, when an element for fastening a tension bowstring is limb.

In an alternative variant of embodiment of the invention in the case when pulleys have two peripheral surfaces 8 and 9, the tension bowstrings 5 and 6 can be fixed in a different manner: the tension bowstring 6 can be fixed not to the axis 3, but to an element of fastening of bowstring 10 (see FIG. 6, FIG. 8, FIG. 9) mounted on the axis of rotation of the pulley 1 while the tension bowstring 5 is fixed not to the axis 4, but to an element of fastening of bowstring (not shown) (it is similar to the element of fastening of bowstring 10), mounted on the axis of rotation of the pulley 2. The element of fastening of bowstring can have various suitable shape and also may provide for adjustment of bowstring. Thus the other ends of bowstrings 5 and 6 are fixed similarly to the first variant.

Figure 10:
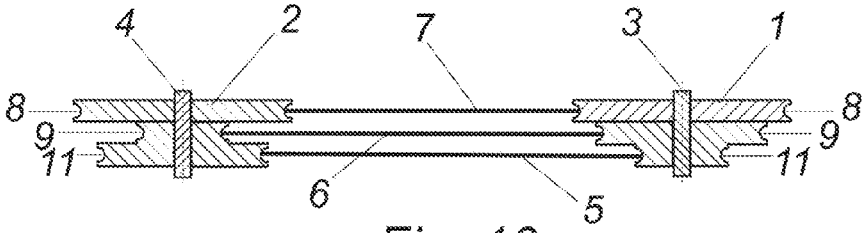
FIG. 10—sectional view of the pulley having three peripheral surfaces when tension bowstrings are passing in essentially parallel planes.
Figure 11:
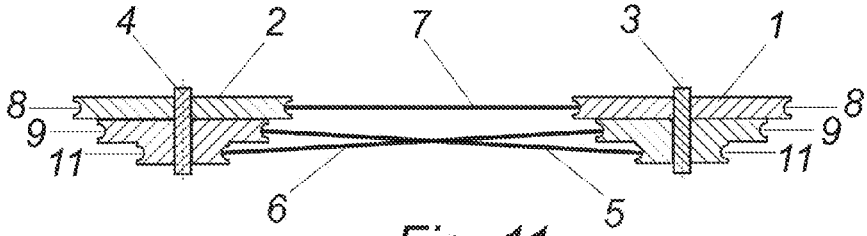
FIG. 11—sectional view of the pulley having three peripheral surfaces, when tension bowstrings are intersecting each other between the second and the third peripheral surfaces of pulleys.

As a variant the pulleys can have three peripheral surfaces. In variant of embodiment of unit for fastening a bowstring with pulley 1 and 2, having three peripheral surfaces, the bowstring 7 for throwing a projectile is fixed to the first surface 8 of pulleys 1 and is, at least, partially wrapping them, while the tension bowstrings 5 and 6 are drawn between the corresponding second 9 and third 11 peripheral surfaces, passing in essentially parallel planes (shown in FIG. 10), or are drawn intersecting each other between the second 9 and the third 11 peripheral surfaces of pulleys 1 and 2 (shown in FIG. 11).

The unit operates as follows.

Figure 7:
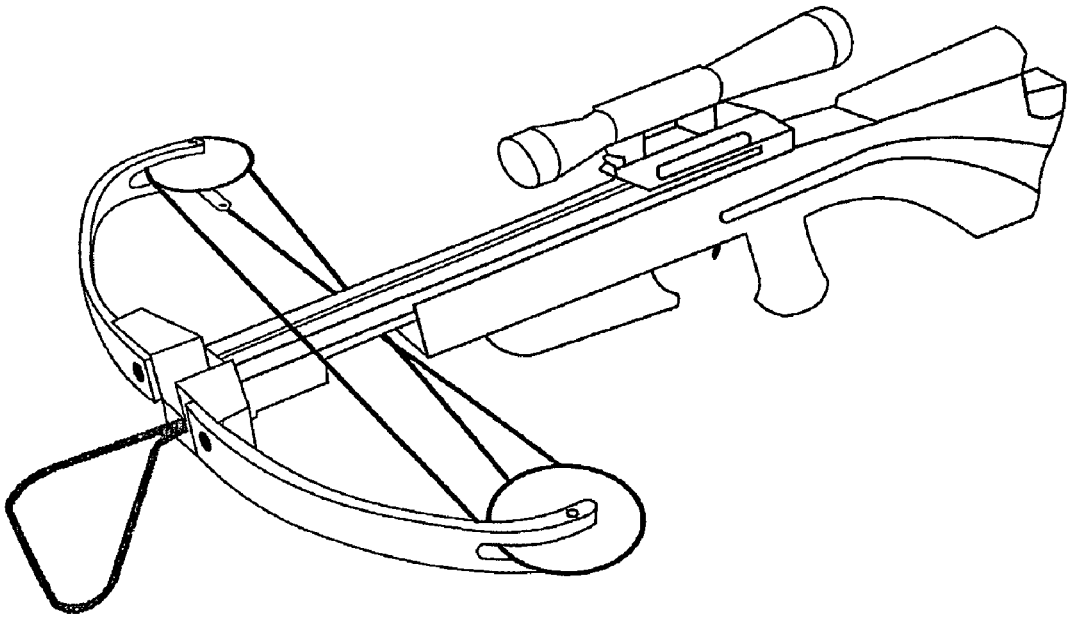
FIG. 7—perspective view of a crossbow containing a unit for fastening a bowstring according to this invention, in a not cocked position.

The unit represents the pulleys mounted on the throwing device having a bowstring for throwing a projectile and tension bowstrings drawn between them. When rendering the throwing device to the cocked position the bowstring for throwing a projectile is drawn at a value of the power stroke length. Thus, due to its mounting on the pulleys in the proposed manner the bowstring for throwing a projectile intersects the tension bowstrings. Besides the angle formed by a bowstring for throwing a projectile, becomes smaller, than in case of conventional fastening of bowstring, and the length of power stroke increases. As a result, the force applied to a projectile to be thrown, increases. In FIG. 7 the general view of a crossbow with the bowstrings tension unit according to the invention is shown.

Though the invention is shown and described with references to some variants of its embodiment, it is clear to experts in the art, that it is possible to make various changes as to their form and details without deviating from spirit and scope of the invention.

The invention claimed is:

1. A unit for fastening a bowstring of a throwing device, containing:

a first pulley mounted for rotation on an axis of rotation of the first pulley having a first and a second essentially cylindrical peripheral surfaces, a second pulley mounted for rotation on an axis of rotation of the second pulley, spaced apart from the axis of rotation of the first pulley, having a first and a second essentially cylindrical peripheral surfaces, a bowstring for throwing a projectile, wherein the bowstring for throwing a projectile has a one end fixed to the first pulley, and an other end fixed to the second pulley so the bowstring for throwing a projectile is, at least, partly wrapping the first essentially cylindrical peripheral surfaces of the first and the second pulleys, a first tension bowstring, a second tension bowstring, a first element for fastening the first tension bowstring, mounted on the axis of rotation of the first pulley, the first element for fastening the first tension bowstring being a separated element, independent from the first pulley, the first tension bowstring fastening to it at a distance from the axis of rotation of the first pulley, and a second element for fastening the second tension bowstring, mounted on the axis of rotation of the second pulley, the second element for fastening the second tension bowstring being a separated element, independent from the second pulley, the second tension bowstring fastening to it at a distance from the axis of rotation of the second pulley, wherein the first tension bowstring has a one end fixed to the first element for fastening the first tension bowstring, and an other end fixed to the second pulley so the first tension bowstring is, at least, partly wrapping the second peripheral surface of the second pulley, the second tension bowstring has a one end fixed to the second element for fastening the second tension bowstring, and an other end fixed to the first pulley so the second tension bowstring is, at least, partly wrapping the second peripheral surface of the first pulley and intersects the first tension bowstring, and when rendering the throwing device to a cocked position the bowstring for throwing a projectile intersects the first and the second tension bowstrings.

2. A unit of claim 1 wherein the first and second pulleys have a shape of a circular cylinder.

3. A unit of claim 1 wherein the first and second pulleys have a shape of an elliptic cylinder.

4. A unit of claim 1 wherein the axis of rotation of the first pulley passes through the center of the first pulley.

5. A unit of claim 1 wherein the axis of rotation of the second pulley passes through the center of the second pulley.

6. A unit of claim 1 wherein the axis of rotation of the first pulley is displaced about the center of the first pulley.

7. A unit of claim 1 wherein the axis of rotation of the second pulley is displaced about the center of the second pulley.

8. A unit of claim 1 wherein said unit is adapted for mounting on a crossbow.

9. A unit of claim 1 wherein said unit is adapted for mounting on a bow.

10. A unit for fastening a bowstring of a throwing device, containing:

a first pulley mounted for rotation about an axis of rotation of the first pulley and having a first, a second and a third essentially cylindrical peripheral surfaces, a second pulley mounted for rotation about an axis of rotation of the second pulley, spaced apart from the axis of rotation of the first pulley, and having a first, a second and a third essentially cylindrical peripheral surfaces, a bowstring for throwing a projectile, a first tension bowstring, a second tension bowstring, wherein the bowstring for throwing a projectile has a one end fixed to the first pulley, and an other end fixed to the second pulley so the bowstring for throwing a projectile is, at least, partly wrapping the first peripheral surfaces of the first and the second pulleys, the first tension bowstring having a one end fixed to the first pulley, and an other end fixed to the second pulley so the first tension bowstring is, at least, partly wrapping the second peripheral surfaces of the first and the second pulleys, the second tension bowstring having a one end fixed to the second pulley, and an other end fixed to the first pulley so the second tension bowstring is, at least, partly wrapping the third peripheral surfaces of the first and the second pulleys, wherein said first, second and third essentially cylindrical peripheral surfaces of the first pulley are situated in different planes perpendicular to the axis of rotation of the first pulley, and said first, second and third essentially cylindrical peripheral surfaces of the second pulley are situated in different planes perpendicular to the axis of rotation of the second pulley, and wherein said first essentially cylindrical peripheral surface of the first pulley is situated above said second and third essentially cylindrical peripheral surfaces of the first pulley, and said first essentially cylindrical peripheral surface of the second pulley is situated above said second and third essentially cylindrical peripheral surfaces of the second pulley, and said second and third essentially cylindrical peripheral surfaces of the first pulley to which the ends of the bowstrings situated in the same planes are fixed are situated at different distances from the axis of rotation of the first pulley, and said second and third essentially cylindrical peripheral surfaces of the second pulley to which the ends of the bowstrings situated in the same planes are fixed are situated at different distances from the axis of rotation of the second pulley, thus when rendering the throwing device to a cocked position the bowstring for throwing a projectile intersects the first and the second tension bowstrings.

11. A unit of claim 10 wherein the first and second pulleys have a shape of a circular cylinder.

12. A unit of claim 10 wherein the first and second pulleys have a shape of an elliptic cylinder.

13. A unit of claim 10 wherein the axis of rotation of the first pulley passes through the center of the first pulley.

14. A unit of claim 10 wherein the axis of rotation of the second pulley passes through the center of the second pulley.

15. A unit of claim 10 wherein the axis of rotation of the first pulley is displaced about the center of the first pulley.

16. A unit of claim 10 wherein the axis of rotation of the second pulley is displaced about the center of the second pulley.

17. A unit of claim 10 wherein said unit is adapted for mounting on a crossbow.

18. A unit of claim 10 wherein said unit is adapted for mounting on a bow.

* * * * *